US011627858B2

(12) United States Patent
Hattin

(10) Patent No.: US 11,627,858 B2
(45) Date of Patent: Apr. 18, 2023

(54) CLEANING DEVICE WITH A DISPOSABLE CLEANING HEAD

(71) Applicant: Robert Samuel Hattin, Grimsby (CA)

(72) Inventor: Robert Samuel Hattin, Grimsby (CA)

( * ) Notice: Subject to any disclaimer, the term of this patent is extended or adjusted under 35 U.S.C. 154(b) by 126 days.

(21) Appl. No.: 17/110,988

(22) Filed: Dec. 3, 2020

(65) Prior Publication Data

US 2021/0169301 A1 Jun. 10, 2021

Related U.S. Application Data

(60) Provisional application No. 62/946,041, filed on Dec. 10, 2019.

(51) Int. Cl.

| | |
|---|---|
| ***A47L 13/44*** | (2006.01) |
| ***A47L 13/256*** | (2006.01) |
| ***A47L 13/16*** | (2006.01) |
| ***A47L 13/24*** | (2006.01) |

(52) U.S. Cl.

CPC ..... *A47L 13/44* (2013.01); *A47L 13/16* (2013.01); *A47L 13/256* (2013.01); *A47L 13/24* (2013.01)

(58) Field of Classification Search

CPC ..... A47L 13/44; A47L 13/16; A47L 13/256; A47L 13/24; A47L 13/42; A47L 13/258; A46B 5/0062; A46B 5/0075; A46B 5/0079; A46B 5/0083; A46B 5/002; A46B 5/0033; A46B 5/0041; A46B 5/0054; A46B 5/0058

USPC ..... 15/144.2

See application file for complete search history.

(56) References Cited

U.S. PATENT DOCUMENTS

| | | | | |
|---|---|---|---|---|
| 1,674,983 | A * | 6/1928 | Morton | B25G 1/02 403/111 |
| 10,098,445 | B1 * | 10/2018 | Morad | B25G 3/24 |
| 2001/0029640 | A1 * | 10/2001 | Cassar | B25G 1/02 15/229.6 |
| 2007/0074362 | A1 * | 4/2007 | Michelson | A47L 13/146 424/443 |
| 2007/0119011 | A1 * | 5/2007 | Ho | A46B 5/0062 15/164 |
| 2015/0082566 | A1 * | 3/2015 | Davidshofer | A47L 13/12 15/118 |

(Continued)

*Primary Examiner* — Monica S Carter
*Assistant Examiner* — Jacob Adam Montgomery

(57) ABSTRACT

The present concept a cleaning device comprises; a pole assembly adapted to be detachably connected to a pole end; a head assembly adapted to be detachably connected to a pad; a resilient joint connected at a pole portion to the pole assembly and at a head end to the head assembly, wherein the resilient joint includes a flexible neck disposed between the pole end and the head end. The cleaning device is moveable between a normally retracted position and an extended position, wherein the retracted position the pole assembly pivots about the flexible neck relative the head assembly. The resilient joint further includes a pin channel which extends through the flexible neck, and the pole assembly includes an actuator attached to a plunger pin, whereby selectively urging the actuator longitudinally downward urges the plunger pin downward to extend through the flexible neck into the extended position, such that the plunger pin prevents pivoting of the flexible neck and thereby locks the position of the pole assembly relative to the head assembly in an upright position.

10 Claims, 17 Drawing Sheets

(56) References Cited

U.S. PATENT DOCUMENTS

2020/0129037 A1* 4/2020 Meszaros ..... B25G 1/06

* cited by examiner

CLEANING DEVICE WITH A DISPOSABLE CLEANING HEAD

FIELD OF THE INVENTION

The present concept relates to a cleaning device which has a disposable cleaning head and more particularly to a cleaning device with a disposable cleaning head articulates in all directions, provides a smooth easily cleanable joint and a head which may be removed and attached without touching by the user.

BACKGROUND OF THE INVENTION

The present concept A Cleaning Device with a Disposable Cleaning Head can be used to clean a variety of surfaces. There are cleaning devices which have replaceable or disposable cleaning heads, however the ability to remove and reattach the cleaning head usually requires some manual manipulation and touching by the user of either the cleaning head or mop or portion of the cleaning device. The prior art devices which include a disposable or removable brush head are as follows:

U.S. Pat. No. 41,948,582 to Cupp et al., teaches an applicator for applying a liquid coating to a suitable object that includes a pad and a detachable handle.

U.S. Pat. No. 4,457,038 to Hammond describes a permanent handle for use with a disposable brush or mophead. The handle includes am elongated hollow body having a bottom and top end and the bottom end to releasably and frictionally engage a disposable brush or mophead and secure it in a working position on the handle body.

U.S. Pat. No. 5,010,615 to Carter relates to a hand holdable tool including a handle that is detachably connected to a head unit by a locking and release mechanism that has a snap-lock on the handle and a snap-lock receiver located interlineally of the head.

U.S. Pat. No. 6,463,620 to Busha titled Brush Assembly with Removable/Disposable Head, describes a brush assembly such as for cleaning and sanitizing toilet bowls, having a removable and disposable applicator head. The brush assembly comprises in an elongated handle with a broadening diverging end and applicator head for removing the attachment thereto. There also is described a duel locking means for the applicator head provided where the locking means may be manual released without having to physically handle a soiled applicator head.

A disadvantage with all the prior art devices is that none of the prior art devices allow complete articulation of the cleaning head relative to the handle and in most instances there are a number of small crevices, indentations, and other areas within the cleaning head where germs and other dirt can accumulate making the device less hygienic to handle. Hinges or ball and socket joints are normally employed which are not easily cleanable. A smooth easily cleanable hinged or flexible joint surface is desirable with any instrument that is used to clean surfaces such that bacteria and grime is easily removable.

Additionally often it is not possible to remove and reattach the cleaning head without touching the end of the mop or in the event that it is possible to remove and reattach the cleaning head without having to physically touch the brush head, the mechanisms are highly complicated and as a result extremely costly to build.

SUMMARY OF THE INVENTION

A presently preferred embodiment to which the claims are directed is a cleaning device 100 and is described with reference to FIGS. 17 to 24 inclusively and includes the following major components;

a) a pole assembly 202 adapted to be detachably connected to a pole end 213;

b) a head assembly 204 adapted to be detachably connected to a pad 262;

c) a resilient joint 206 connected at a pole portion 250 to the pole assembly 202 and at a head end 252 to the head assembly 204;

d) the resilient joint 206 includes a flexible neck 254 disposed between the pole portion 250 and the head end 252;

e) the cleaning device moveable between a normally retracted position 220 and an extended position 260, wherein the retracted position 220 the pole assembly 202 pivots about the flexible neck 254 relative the head assembly 204.

The resilient joint 206 further includes a pin channel 256 which extends through the flexible neck 254, and the pole assembly 202 includes an actuator 212 attached to a plunger pin 216, whereby selectively urging the actuator longitudinally downward urges the plunger pin downward to extend through the flexible neck 254 into the extended position 260, such that the plunger pin 216 prevents pivoting of the flexible neck 254 and thereby locks the position of the pole assembly 202 relative to the head assembly 204 in an upright position 270.

BRIEF DESCRIPTION OF THE DRAWINGS

With the intention of providing demonstration of characteristics of the device or method, an example or examples are given below without restrictive character whatsoever with reverence to the corresponding figures of preferred embodiments of the device and method as follows:

FIG. 1 is a schematic top isometric view of the Cleaning Device with a

Disposable Cleaning Head.

Figure 1:
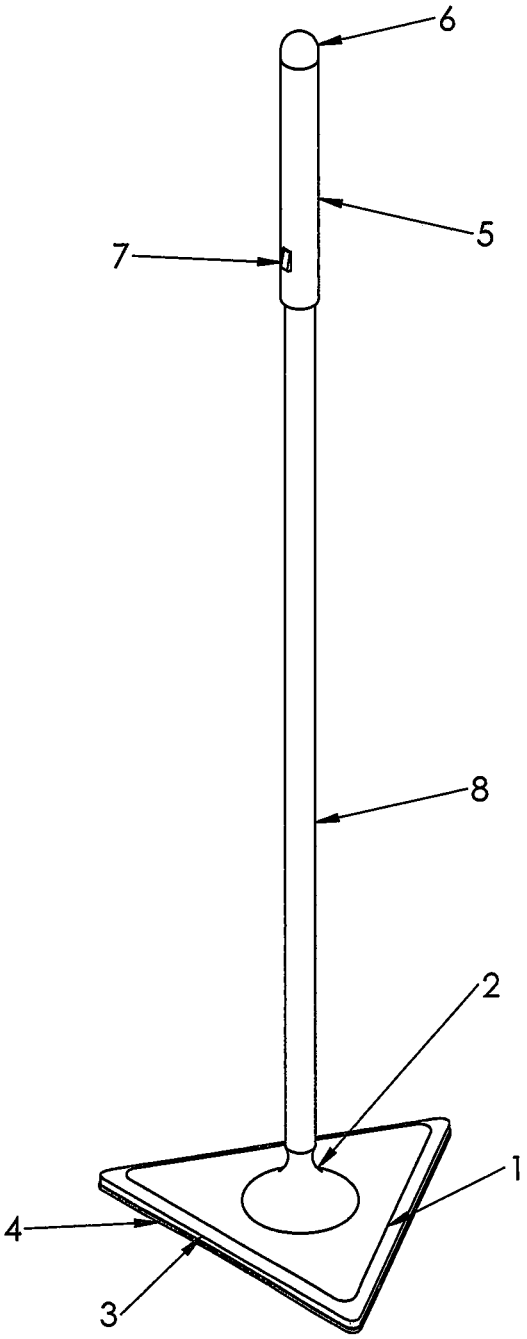
Figure 2:
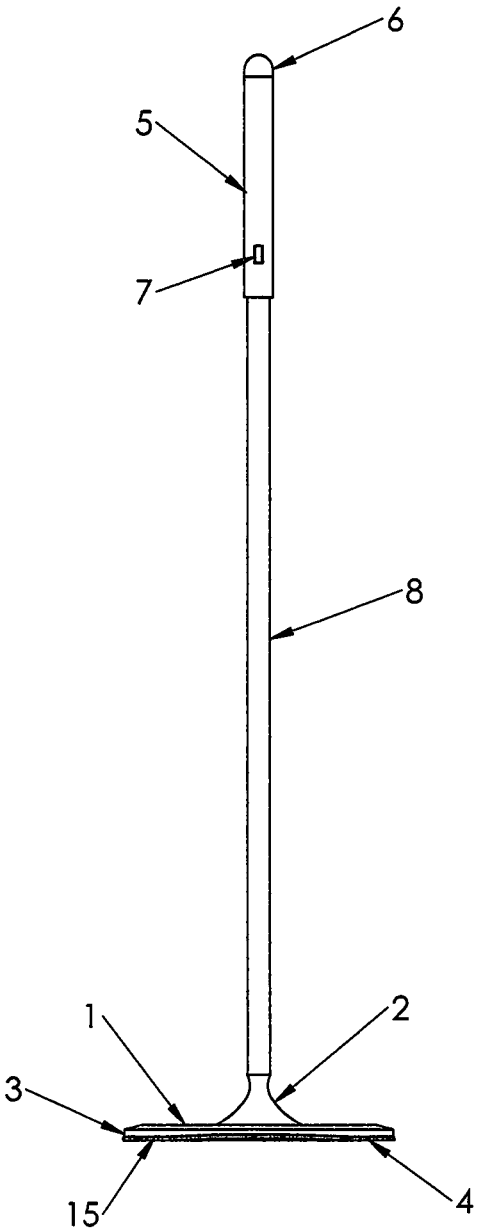

FIG. 2 is a side plan view of the Cleaning Device with a Disposable Cleaning Head shown in FIG. 1.

Figure 3:
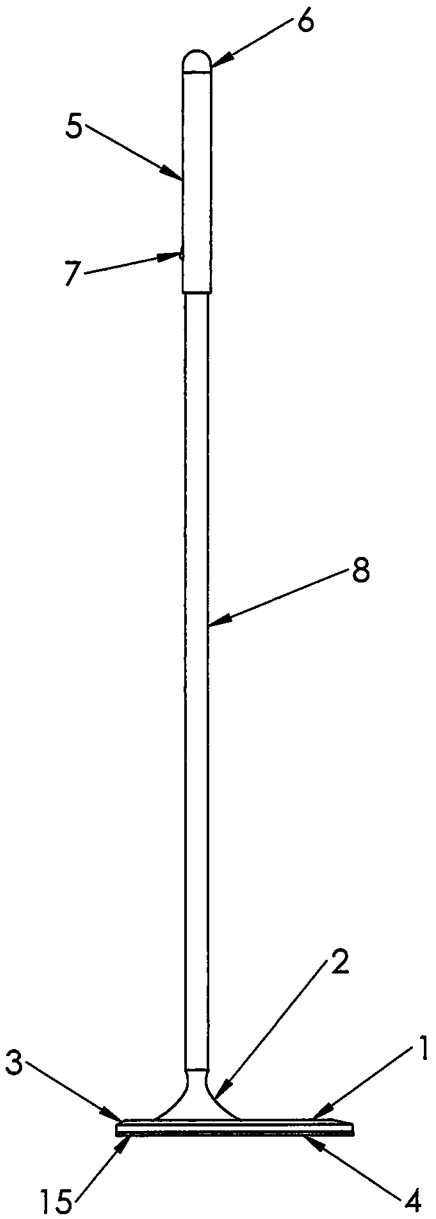

FIG. 3 is a schematic side plan view of another side of the Cleaning Device with a Disposable Cleaning Head shown in FIG. 1.

Figure 4:
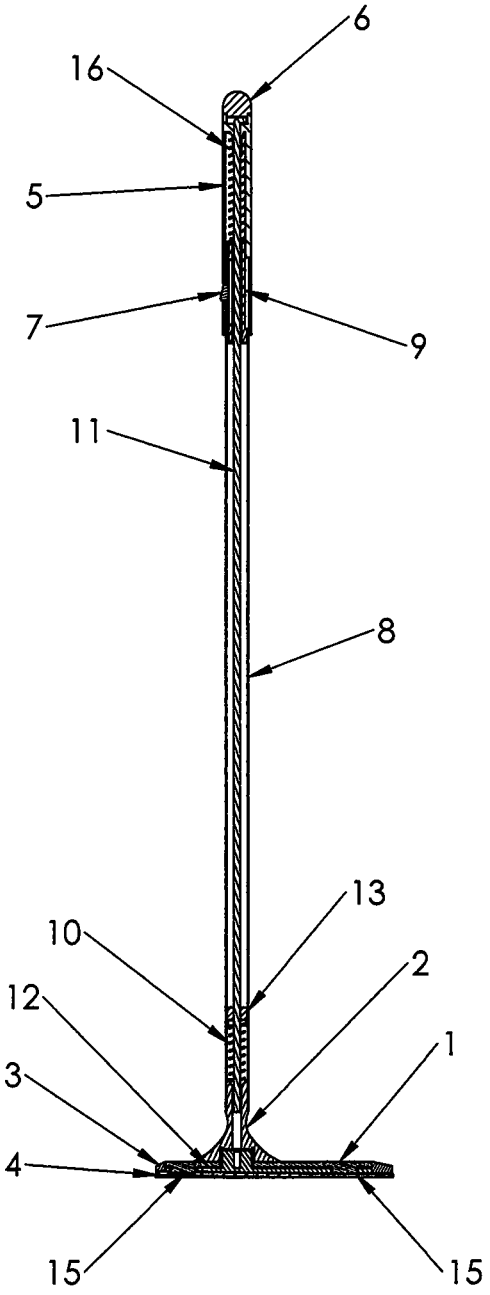

FIG. 4 is a schematic cross-sectional view of the Cleaning Device with a Disposable Cleaning Head as shown in FIG. 3.

Figure 5:
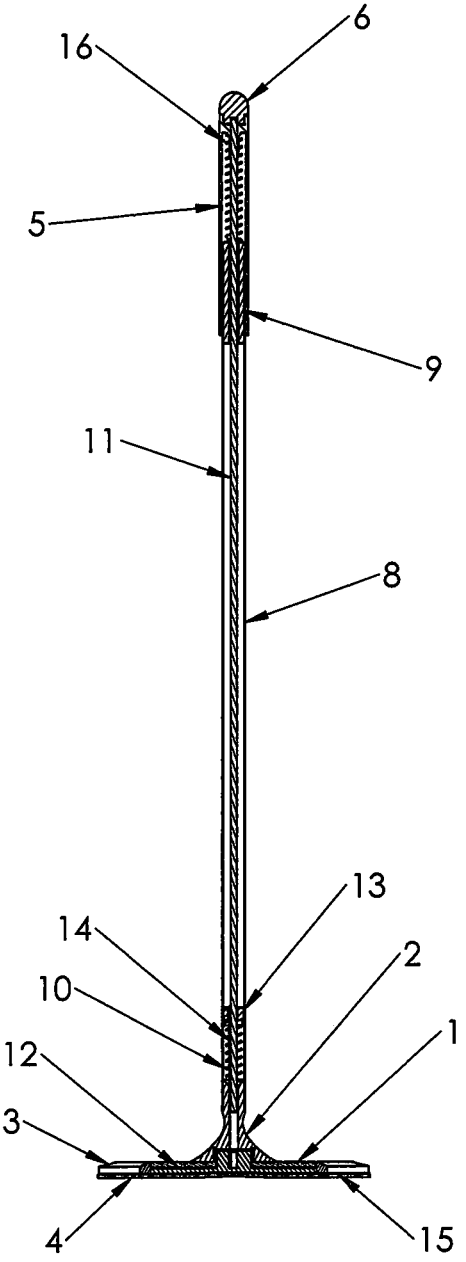

FIG. 5 is a schematic cross-sectional view of the Cleaning Device with a Disposable Cleaning Head as shown in FIG. 2.

Figure 6:
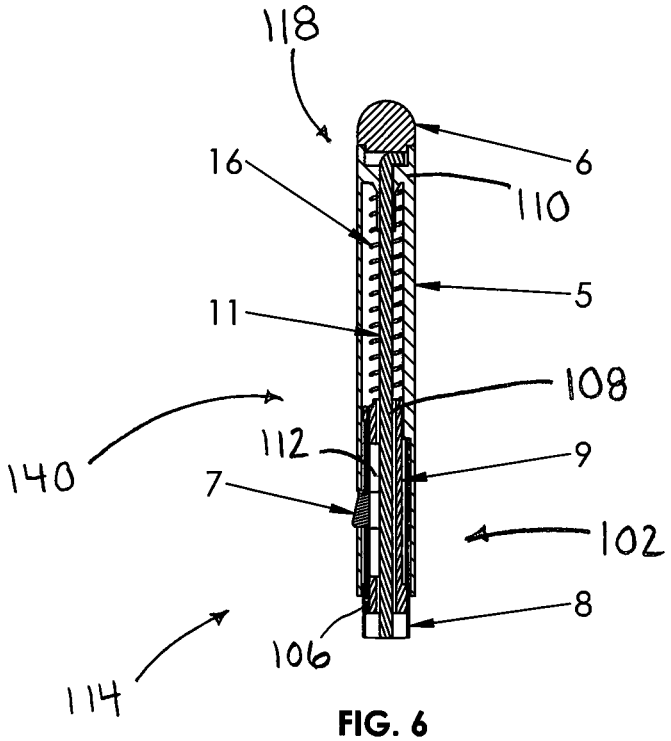

FIG. 6 is a partial enlarged schematic cross-sectional view of a handle assembly 140 of the Cleaning Device with a Disposable Cleaning Head shown in the locked position.

Figure 7:
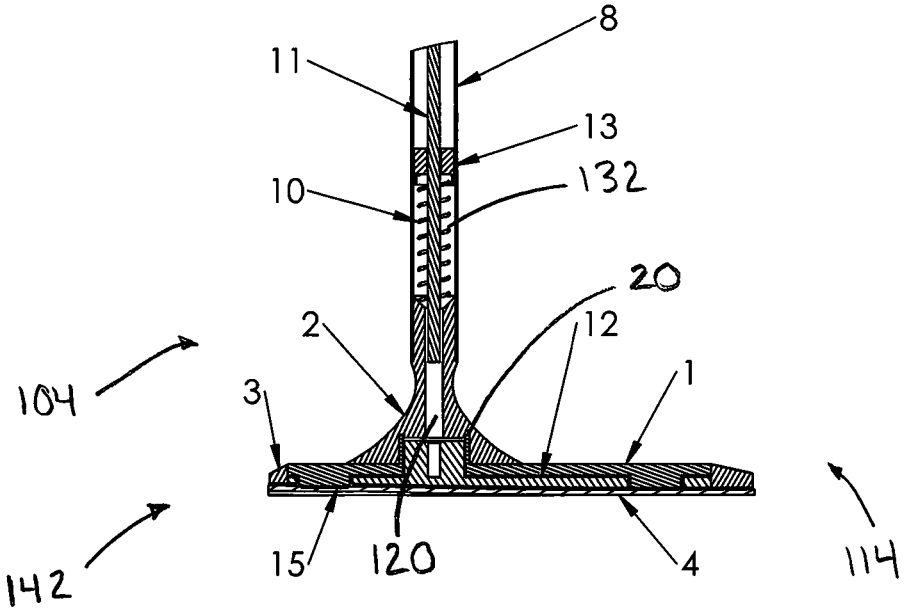

FIG. 7 is a schematic enlarged cross sectional view of the mophead assembly 142 of the Cleaning Device with a Disposable Cleaning Head shown in the locked position.

Figure 8:
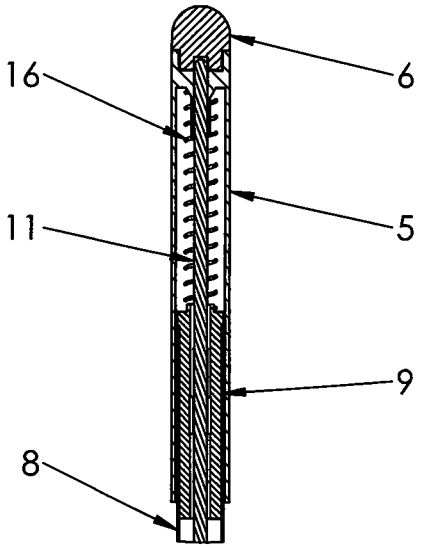

FIG. 8 is a partial enlarged schematic cross-sectional view of a handle assembly of the Cleaning Device with a Disposable Cleaning Head shown in the locked position.

Figure 9:
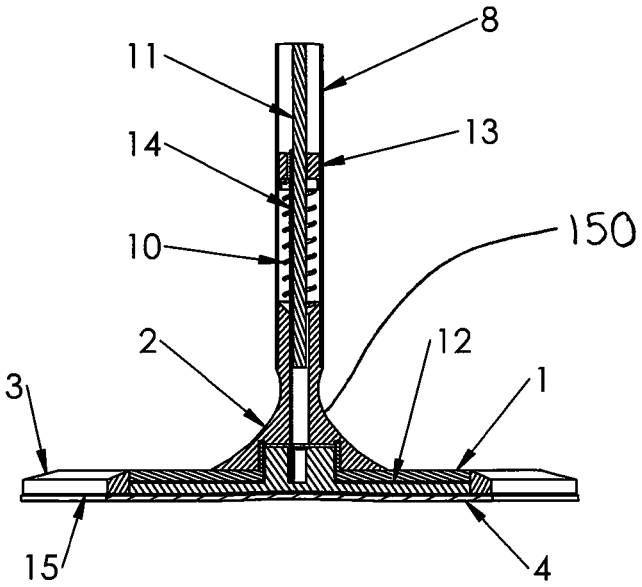

FIG. 9 is a schematic enlarged cross sectional view of the mophead assembly of the Cleaning Device with a Disposable Cleaning Head shown in the locked position.

Figure 10:
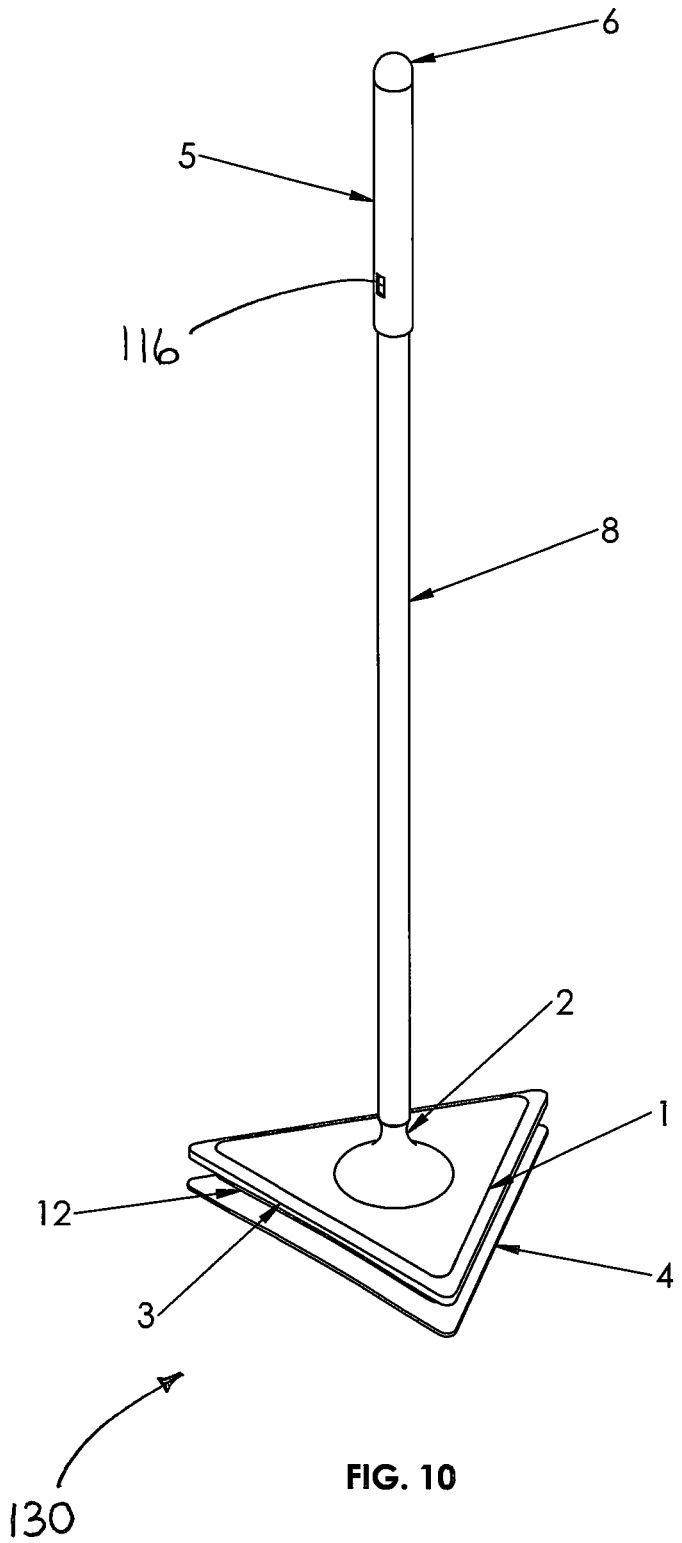

FIG. 10 is a schematic top isometric view of the Cleaning Device with a Disposable Cleaning Head shown in an ejection position.

Figure 11:
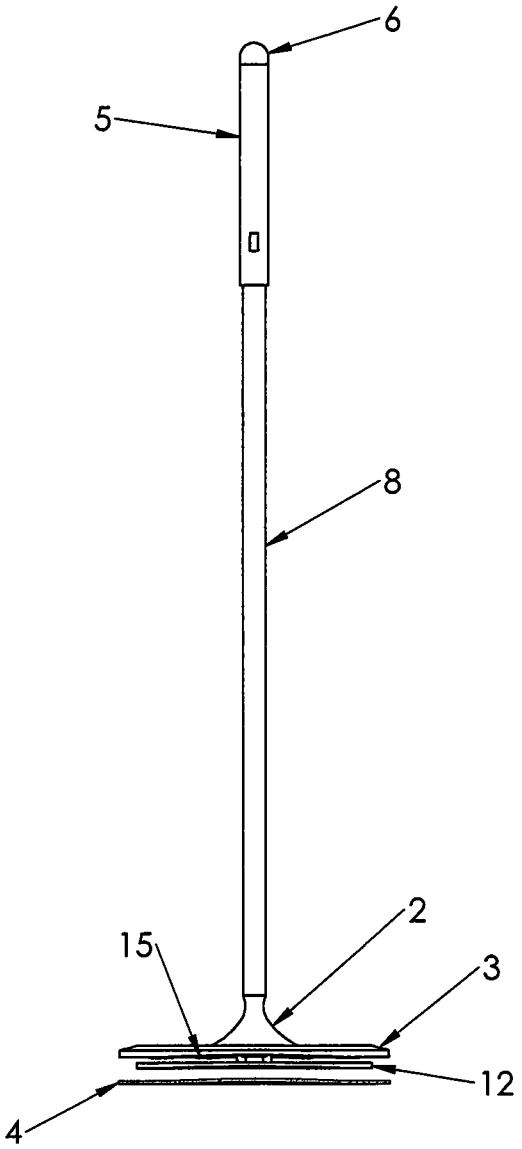

FIG. 11 is a schematic side elevational view of the Cleaning Device with a Disposable Cleaning Head as shown in FIG. 10.

Figure 12:
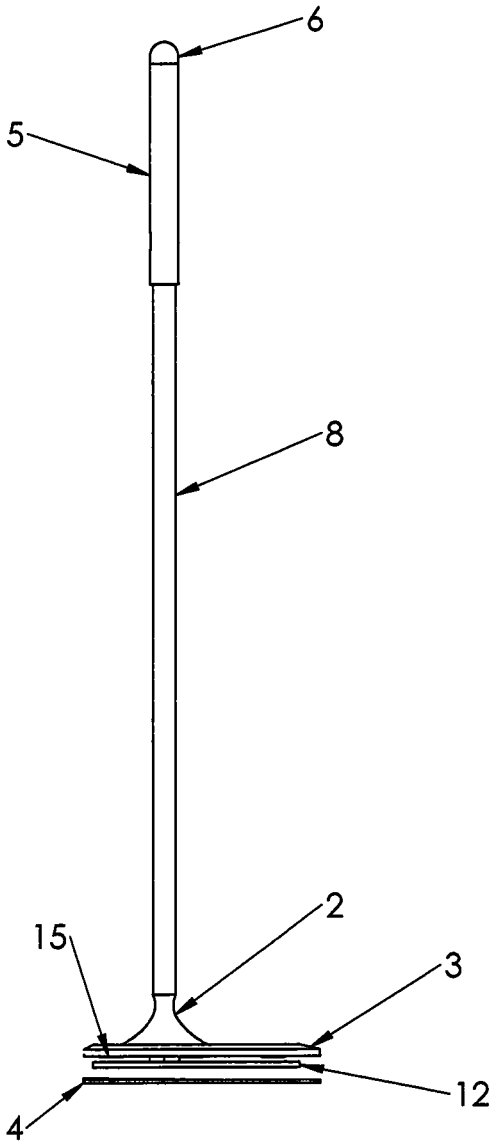

FIG. 12 is a schematic side elevational view of another side of the Cleaning Device with a Disposable Cleaning Head.

Figure 13:
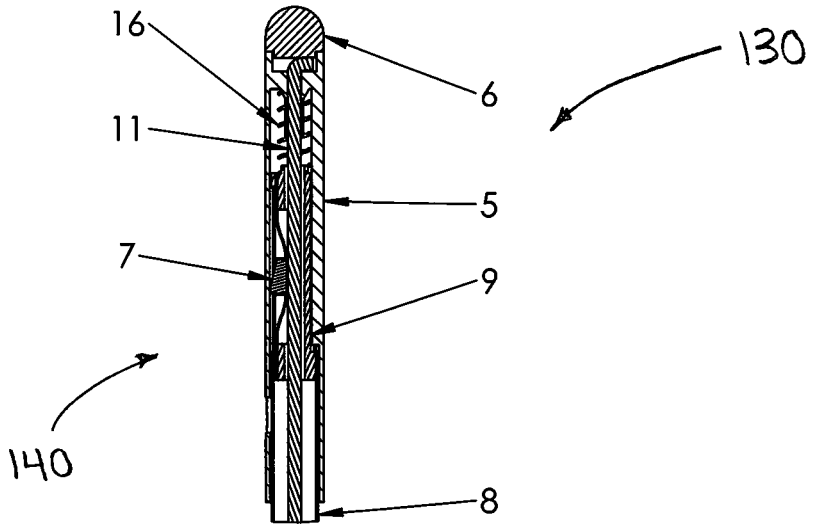

FIG. 13 is a schematic enlarged partial cross-sectional view of the handle assembly shown in an ejection position.

Figure 14:
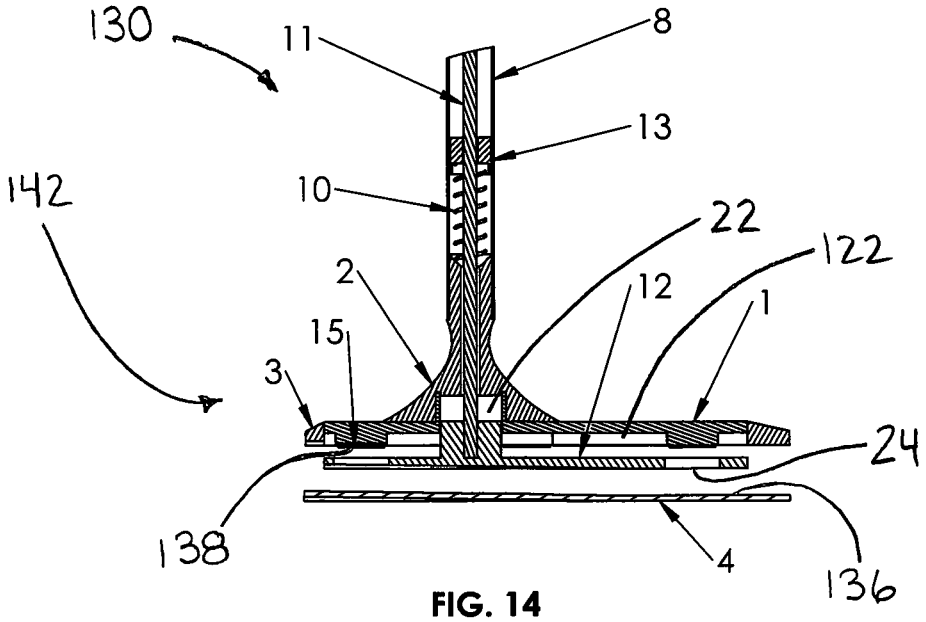

FIG. 14 is a schematic enlarged cross sectional view of the mophead assembly also shown in an ejection position.

Figure 15:
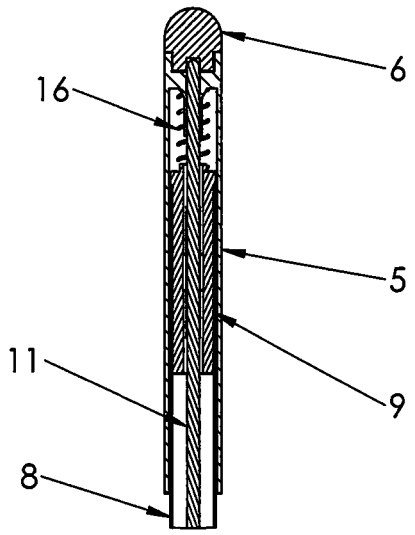

FIG. 15 is a schematic enlarged partial cross-sectional view of the handle assembly shown in an ejection position.

Figure 16:
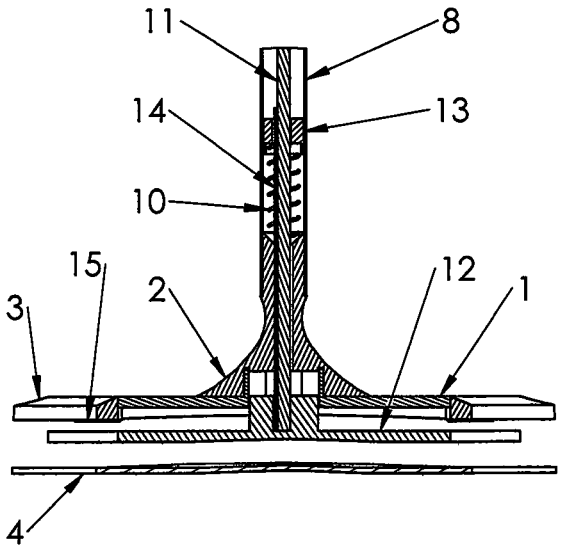

FIG. 16 is a schematic enlarged cross sectional view of the mophead assembly also shown in an ejection position.

Figure 17:
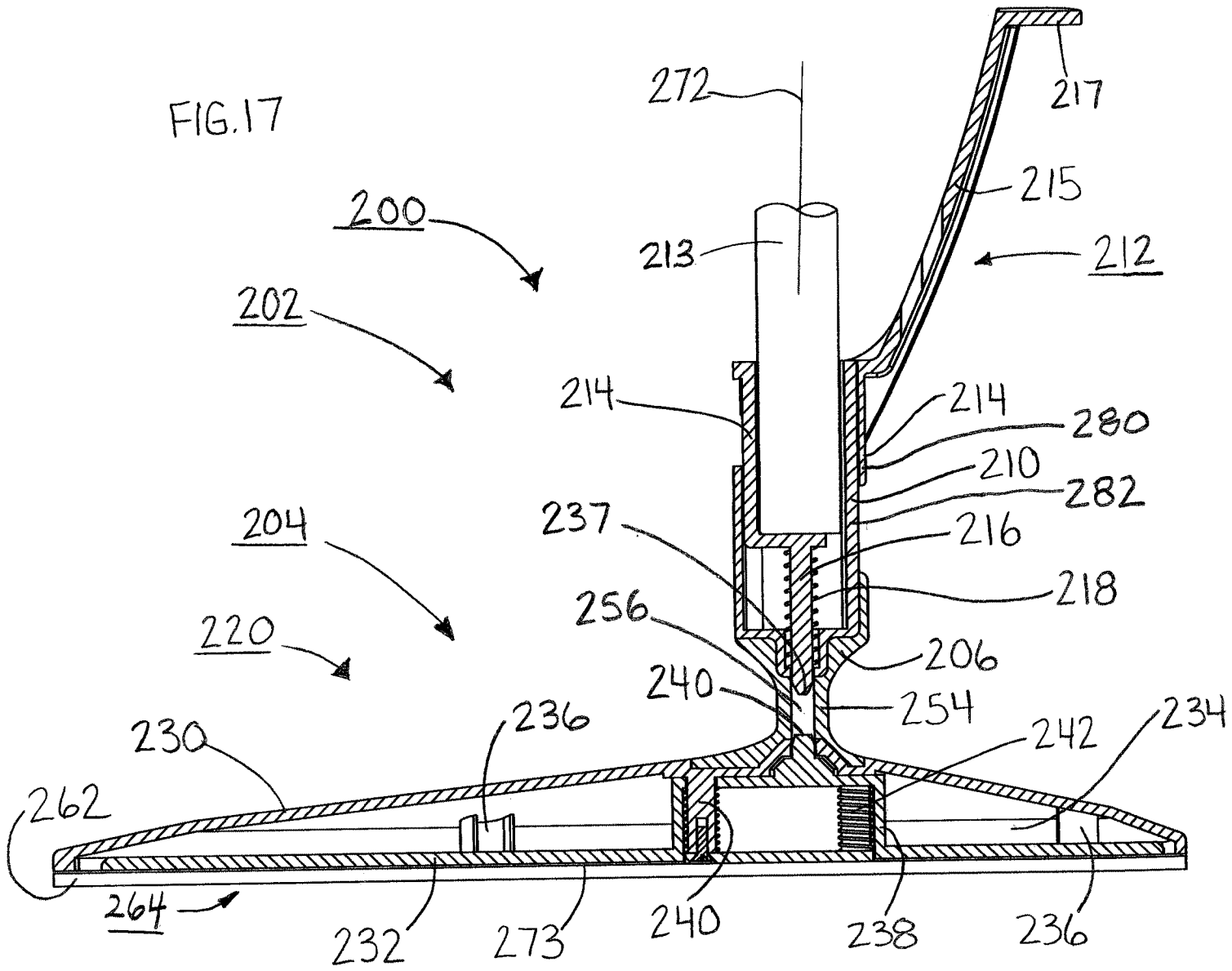

FIG. 17 is a schematic cross sectional view of a presently preferred embodiment namely a cleaning device shown in a retracted position.

Figure 18:
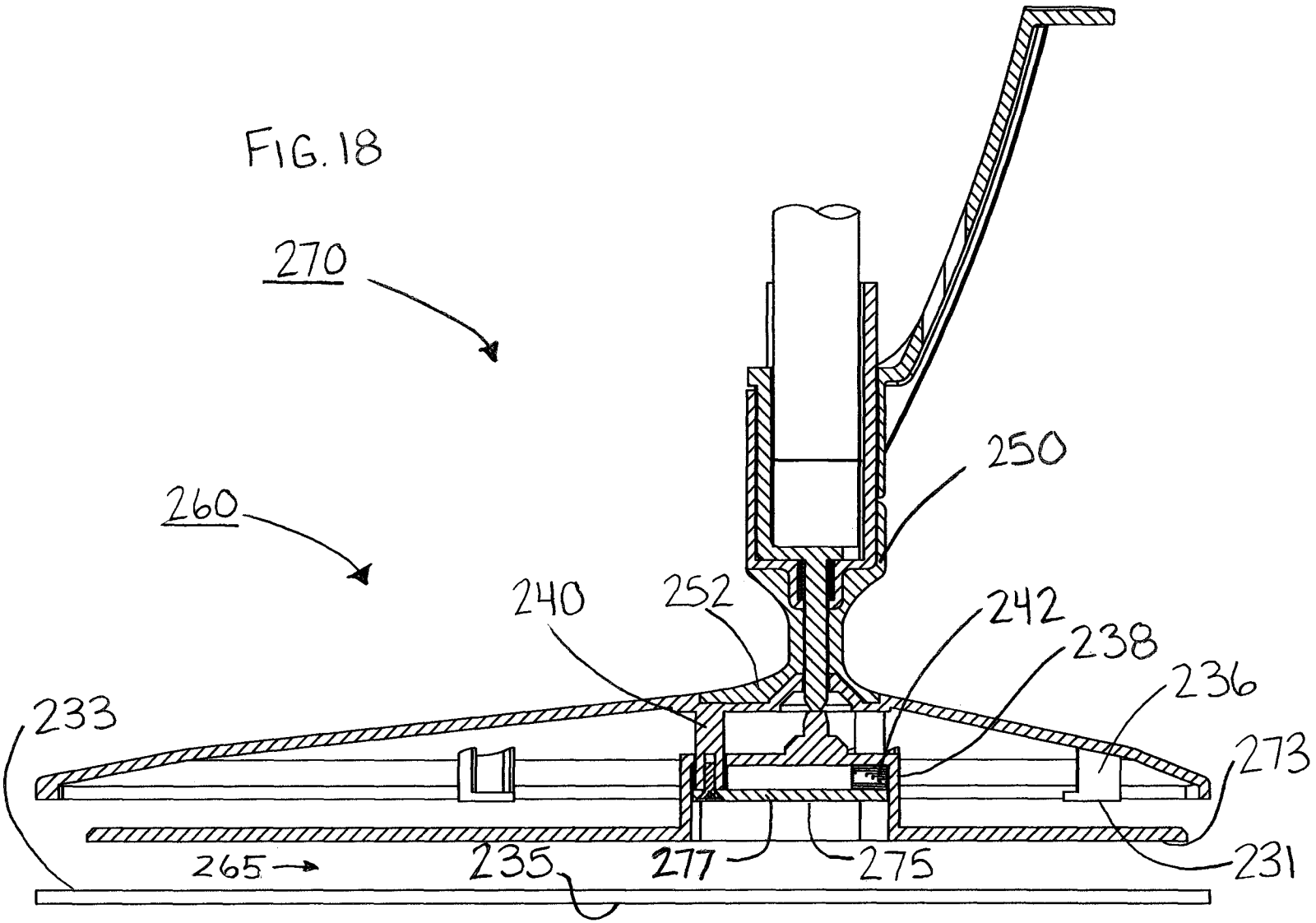

FIG. 18 is a schematic cross sectional view of the cleaning device shown in FIG. 17 in an extended position.

Figure 19:
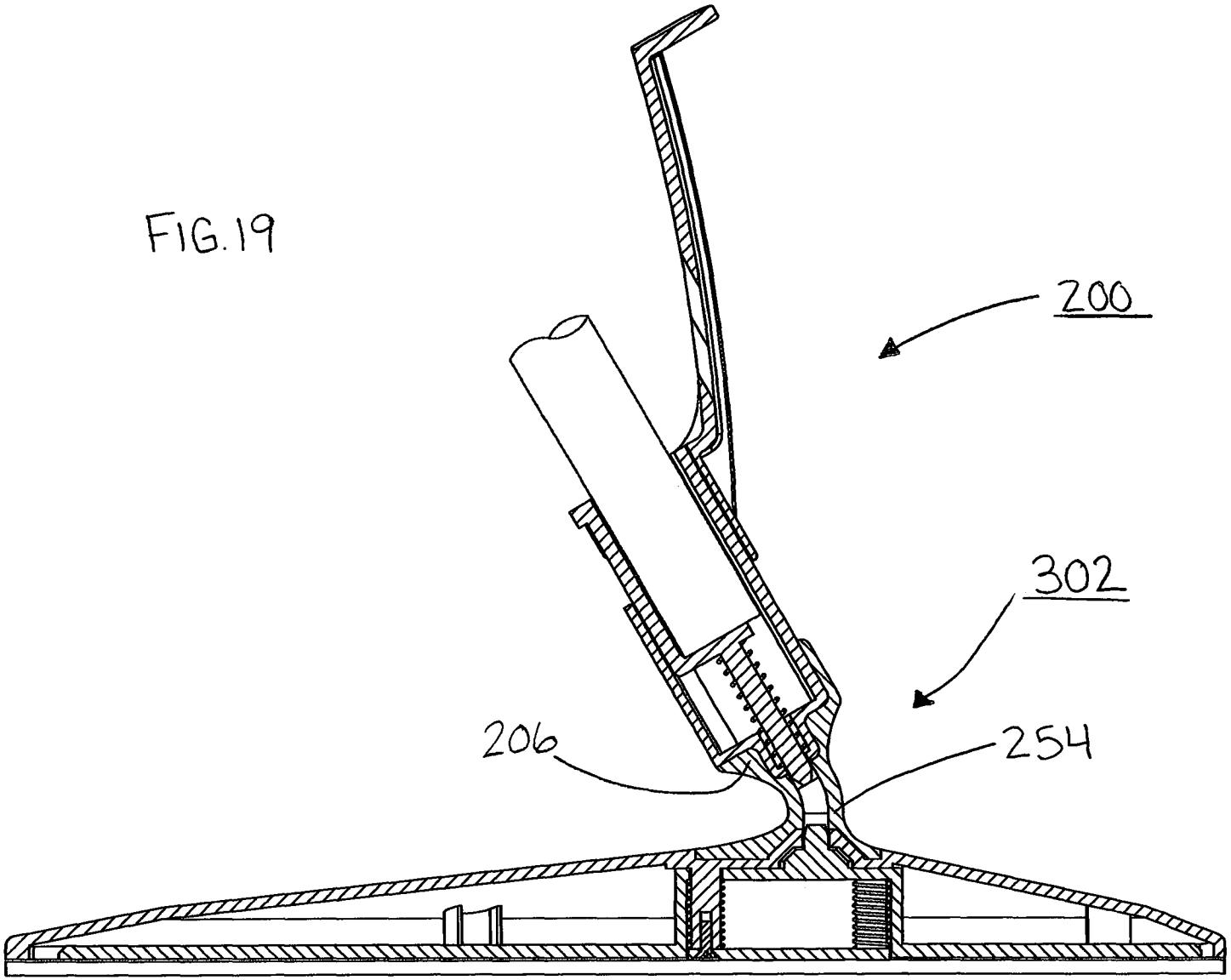

FIG. 19 is a schematic cross sectional view of the cleaning device shown FIG. 17 in a flexed position 302.

Figure 20:
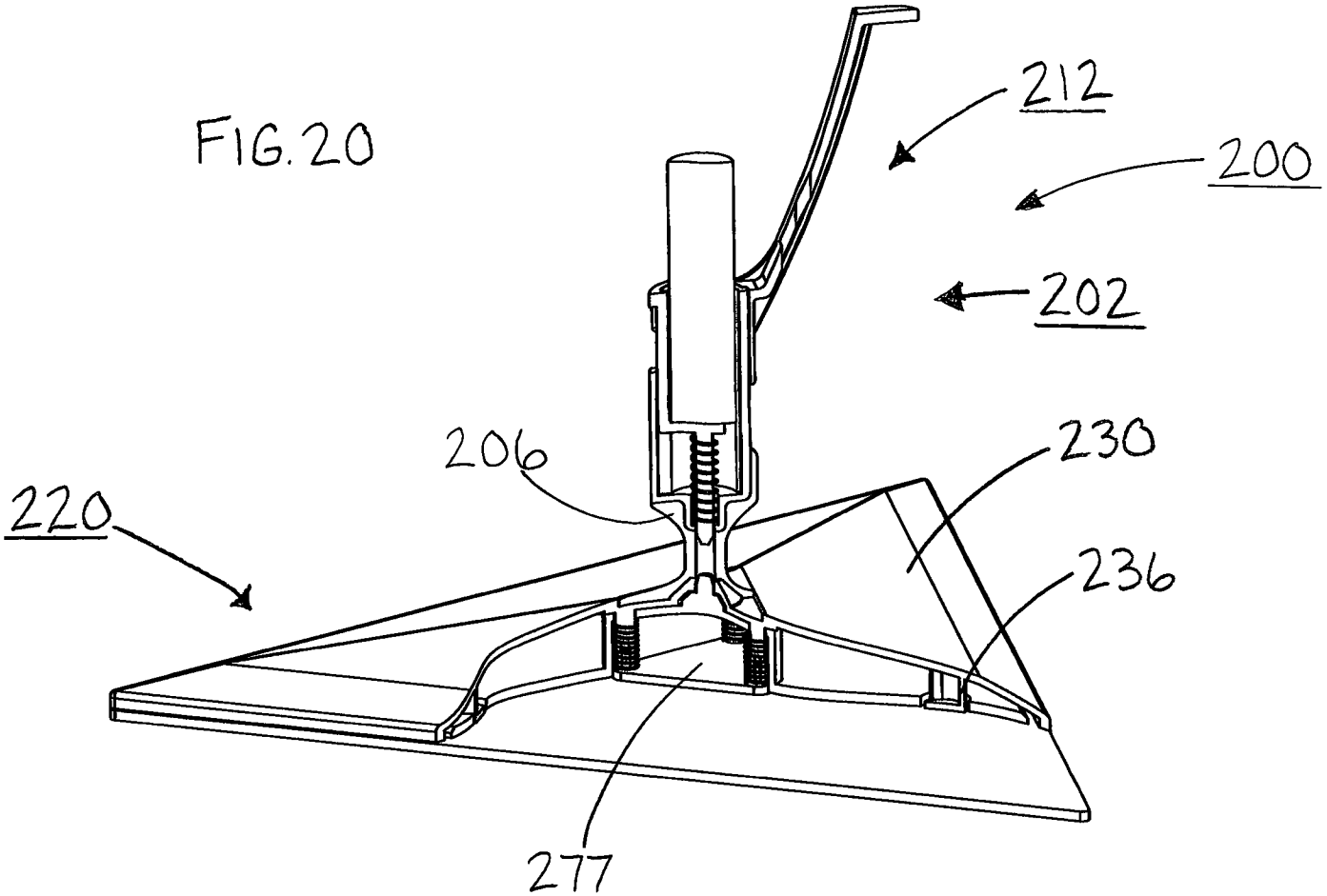

FIG. 20 is a schematic partial cut away view of the cleaning device shown in FIG. 17 shown in a retracted position.

Figure 21:
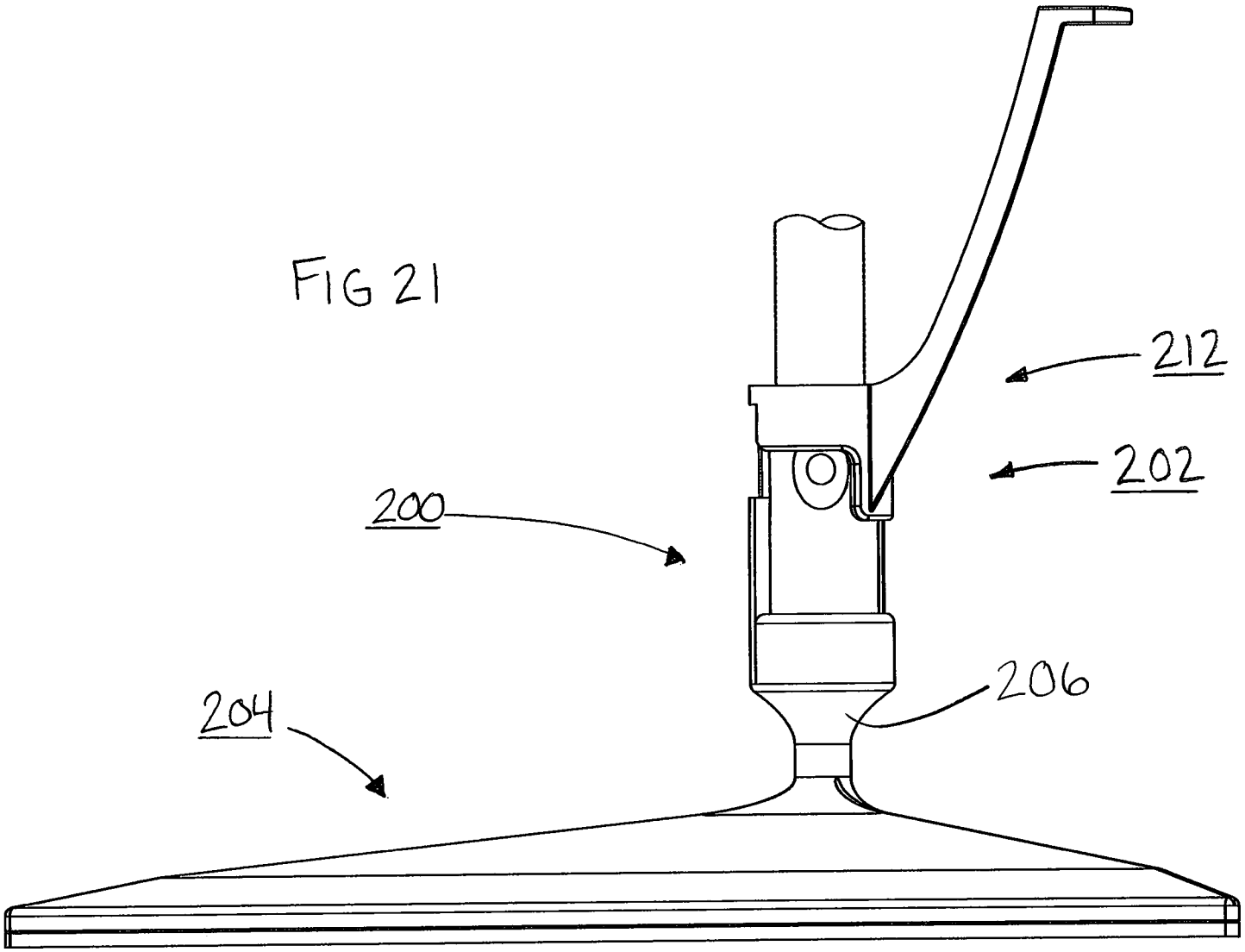

FIG. 21 is a schematic side elevational view of the cleaning device shown in FIG. 17 shown in a retracted position.

Figure 22:
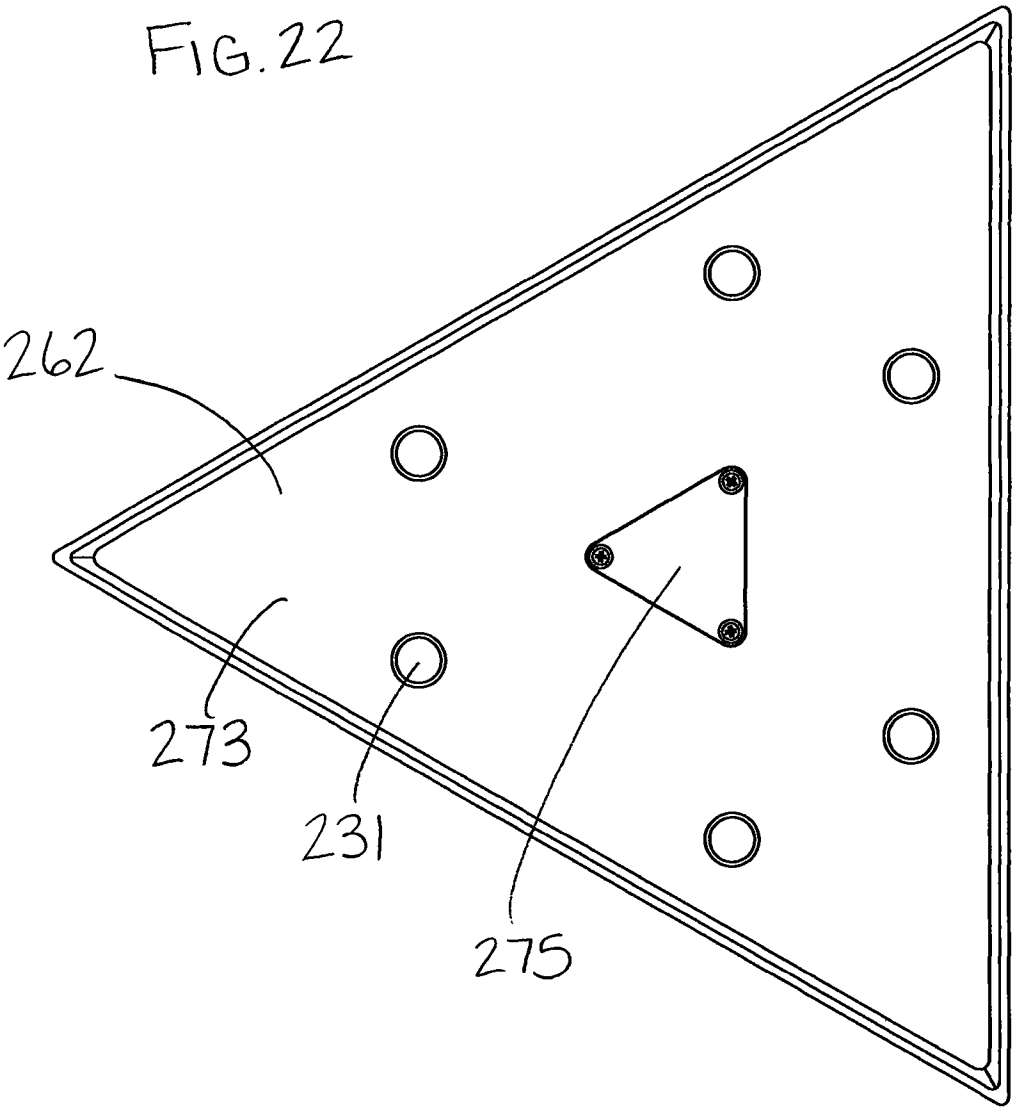

FIG. 22 is a schematic bottom plan view of the cleaning device shown in FIG. 17 with the pad removed revealing the frame pad surface and dowel surfaces.

Figure 23:
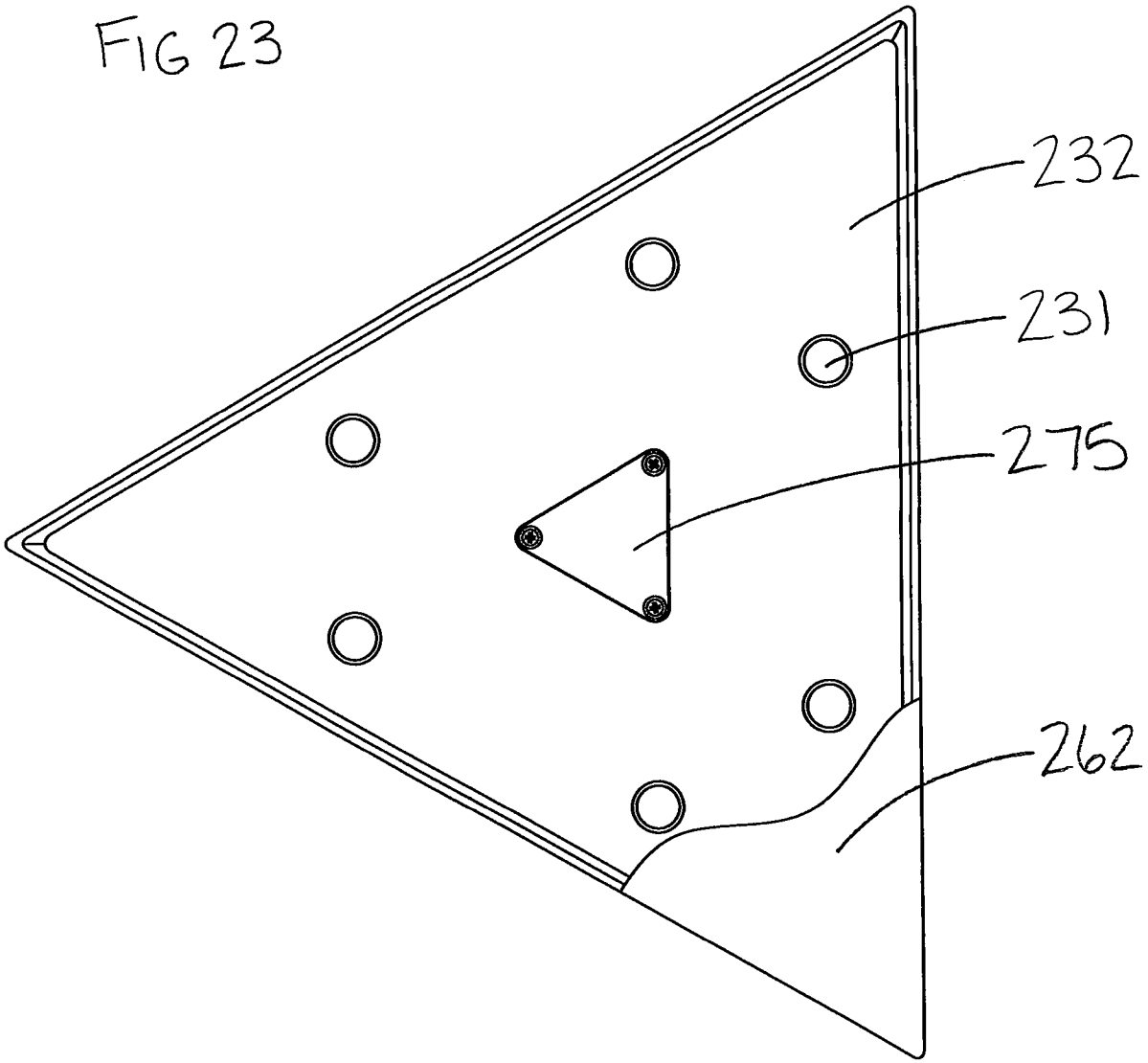

FIG. 23 is a schematic bottom plan view of the cleaning device shown in FIG. 17 with the pad partially removed revealing the frame pad surface and dowel surfaces.

Figure 24:
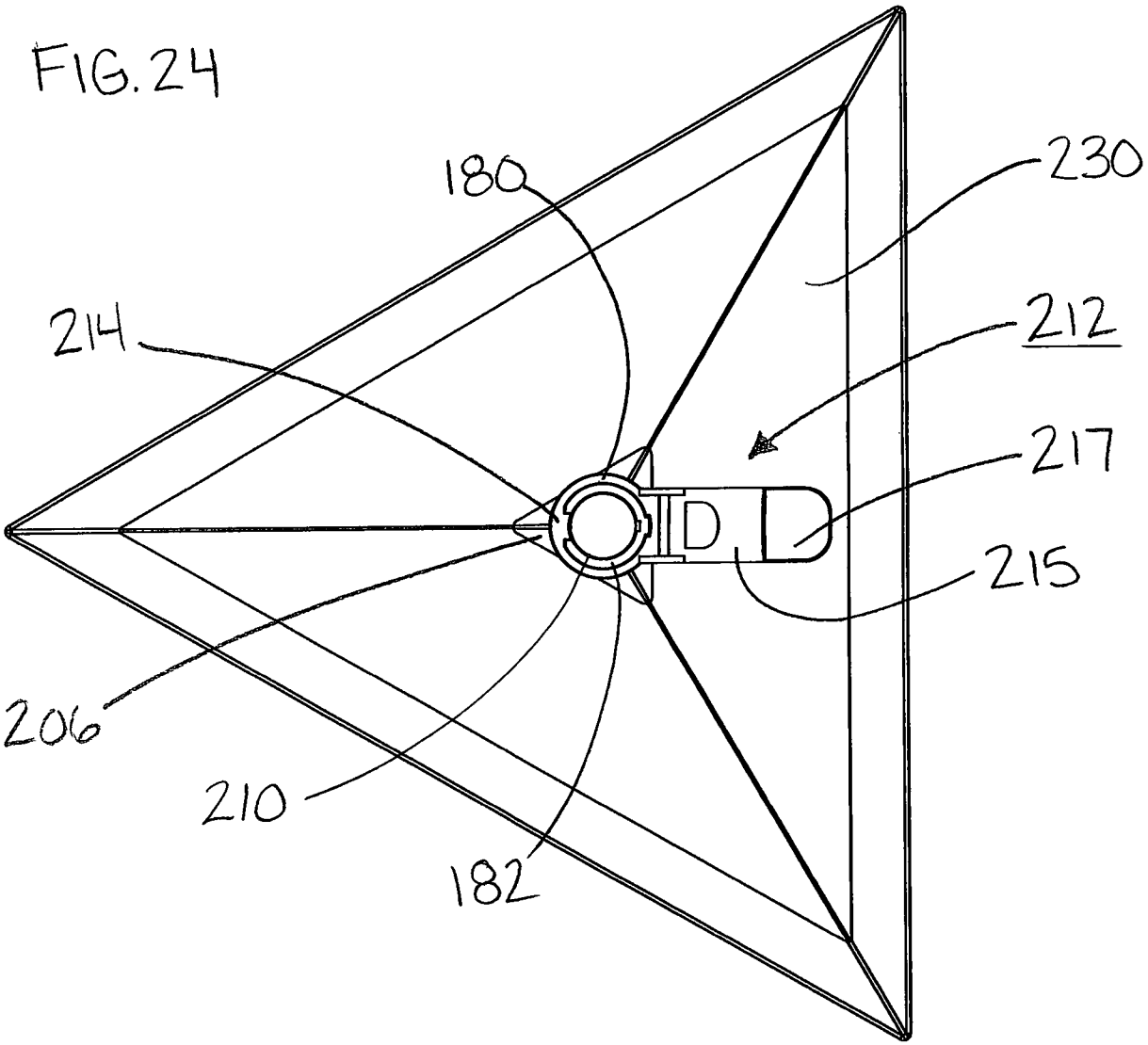

FIG. 24 is a schematic top plan view of the cleaning device shown in FIG. 17 showing the arrangement of the plunger and the pole receiver.

DETAILED DESCRIPTION OF THE PREFERRED EMBODIMENTS

A presently preferred embodiment is depicted in FIGS. 17 to 24 described below under the subheading "A Presently Preferred Embodiment a Cleaning Device" to which the claims are directed.

The present concept A Cleaning Device with a Disposable Cleaning Head includes a tube 8 which is slidably received within an handle 5 at a handle end 102 and is rigidly connected to an elastomer joint 2 at a head end 104.

A lower portion 106 of a keywayed cylinder 9 is rigidly connected to the tube 8 at the handle end 102 wherein an upper portion 108 of the cylinder 9 is slidably received within the handle 5.

A handle spring 16 is slidably housed within the handle 5 and extends between a handle spring stop 110 and a keywayed cylinder 9.

A button spring lock 7 is resiliently housed between keyway 112 and the handle 5 such that in a normally locked position 114 the button resiliently projects through a button aperture 116 thereby preventing the handle 5 from sliding along the tube 8.

A pushrod 11 is housed longitudinally and concentrically within the tube 8 and is rigidly connected at a top-end 118 to the handle and slidably connected within a passageway 120 within the elastomer joint 2.

A mophead 1 which includes a push pad recess 122 is rigidly connected to the elastomer joint 2. A push pad 12 is slidably received within the push pad recess 122 within the mophead 1 in the lock position 114.

A cleaning pad 4 is releasably attached to the mophead 1 wherein the locked position 114, the mophead 1 is free to move relative to the handle 5 by elastically deforming the elastomer joint 2, and is restricted only by the elastomer joint 2 which returns the tube 8 and the handle 5 to a substantially vertical position upon release of the handle 5.

The reader will note that the handle 5 is movable between the locked position 114 as shown in FIG. 6 and an ejection position 130 as shown in FIG. 13 and is achieved by depressing the button spring lock 7 and urging the handle 5 downwardly against the bias of the handle spring 16 which in turn urges the push rod 11 through the passageway 120 of the elastomer joint 2 and urges the push pad 12 away from the mop head 1 which is configured to release the cleaning pad 4 from the push pad 12.

The handle assembly is shown in FIG. 6 in the locked position 114 and in the unlocked or ejection position 130 in FIG. 13. The mop head assembly 142 is shown in FIG. 7 in a locked position 114 and the mop head assembly 142 is shown in FIG. 14 in an ejection position 130. The tube lower end 132 is shown in FIG. 7 and houses a plunger spring 10 which extends between a collar spring stop 13 and the elastomer joint 2 such that in the ejection position 130 the plunger spring 10 is compressed and biased to return the handle 5 to the normally locked position 114.

The mophead 1 further includes tab ends 15 which extend through push pad recesses 122 in the push pad 12 and wherein the tab ends 15 are configured to releasably connect to the cleaning pad 4 in the locked position 114 and disconnect from cleaning pad 4 in the ejection position 130.

The tab ends 15 include hook and loop fastener 134 and are affixed thereon and cooperatively connect with hook and loop fasteners 136 affixed to cleaning pad 4.

The push pad 12 includes a locating plunger shoulder 20 which is cooperatively received within in a shoulder receiver 22 in the mophead 1.

The reader will further note that elastomer joint 2 includes an elastomer outer surface 150 which can be made extremely smooth and allows complete articulation of the handle assembly 140 relative to the mop head assembly 142 restricted only by the resilient nature of the elastomer joint 2.

A Presently Preferred Embodiment a Cleaning Device

A presently preferred embodiment is a cleaning device 200 and is described with reference to FIGS. 17 to 24 inclusively and includes the following major components;

a) a pole assembly 202 adapted to be detachably connected to a pole end 213;

b) a head assembly 204 adapted to be detachably connected to a pad 262;

c) a resilient joint 206 connected at a pole portion 250 to the pole assembly 202 and at a head end 252 to the head assembly 204;

d) the resilient joint 206 includes a flexible neck 254 disposed between the pole portion 250 and the head end 252;

e) the cleaning device moveable between a normally retracted position 220 and an extended position 260, wherein the retracted position 220 the pole assembly 202 pivots about the flexible neck 254 relative the head assembly 204.

The resilient joint 206 further includes a pin channel 256 which extends through the flexible neck 254, and the pole assembly 202 includes an actuator 212 attached to a plunger pin 216, whereby selectively urging the actuator longitudinally downward urges the plunger pin downward to extend through the flexible neck 254 into the extended position 260, such that the plunger pin 216 prevents pivoting of the flexible neck 254 and thereby locks the position of the pole assembly 202 relative to the head assembly 204 in an upright position 270.

The reader will further note that resilient joint 206 includes an elastomer outer surface which can be made extremely smooth and allows complete articulation of the pole assembly 202 relative to the head assembly 204 restricted only by the resilient nature of the resilient joint 206.

In the normally retracted position 220 a plunger spring 218 biases the actuator such that the plunger pin 216 is operably retracted out of the pin channel 256 thereby allowing the pole assembly 202 to pivot about the flexible neck 254 relative the head assembly 204.

The pole assembly 202 further includes a rigid pole receiver 210 configured to detachably connect to a pole end 213, the pole receiver 210 is connected to the resilient joint 206 at the pole portion 250.

The actuator includes a plunger 214 rigidly connected to the plunger pin 216, the plunger 214 is slide-ably received along the pole receiver 210; the plunger 214 is operably biased in a normally retracted position 220 with the plunger spring 218 which is mounted around plunger pin 216.

The pole receiver 210 includes a semi cylindrical portion 282 with an internal diameter dimensioned to fit around the pole end 213 and the plunger 214 includes a plunger semi cylindrical portion 280 configured to slide-ably fit around the external diameter of the pole receiver 210, wherein the plunger 214 slides longitudinally along the pole receiver 210. Longitudinal direction 272 is depicted in FIG. 17.

The actuator further includes a handle 217 connected to a distal end of an arm 215, wherein the arm 215 is rigidly connected to the plunger 214 which in turn is connected to the plunger pin 216, whereby urging the handle 217 downwardly moves the device 200 from a normally retracted position 220 to an extended position 260.

The head assembly includes a base 238 slide-ably received with a frame 230 which is rigidly attached to the head end 252 of the resilient joint 254; wherein the base 232 is moveable between the retracted position 220 and the extended position 260 wherein the retracted position 220 the frame 230 is adapted to connect to the pad 262 in an attached position 264 and in an extended position 260 frame 230 is adapted to release the pad 262 in a detached position 265.

The base 238 includes a pin contact surface 240 for receiving a push end 237 of the plunger pin 116 thereon such that urging plunger pin 216 downwardly urges base 232 slide-ably away from frame 230 thereby releasing the pad 262.

The base includes downwardly disposed base guide walls 238 slide-ably received onto downwardly disposed frame guide posts 240 attached to the frame 230 and connected by a planar frame pad portion 277, such that the posts 240 and the walls 238 guide the base 232 longitudinally downwardly when the base 232 is urged between the retracted position 220 and the extended position 260.

The head assembly 204 further includes retraction springs mounted around the posts 240 for urging the base 232 into a normally retracted position 220.

The base 232 includes a base pad surface 273 which provides a rigid abutting surface for pad 262 and does not attach to the pad 262.

The base includes a planar base pad surface 273 and the pad portion 277 includes a planar frame pad surface 275 which is detachably attached to the pad 262, such that in the retracted position the base pad surface 273 and the frame pad surface 275 align along a common plane, and in the extended position these two surfaces are aligned along longitudinally spaced apart planes thereby detaching the pad 262 from the frame pad surface 275.

The frame 230 further includes a sub-frame 234 which includes locating dowels 236 each having a dowel surface 231 detachably attached to the pad 262, such that in the retracted position the base pad surface 273, the dowel surface 231 align along a common plane, and in the extended position 260 these two surfaces are aligned along longitudinally spaced apart planes thereby detaching the pad 262 from the frame pad surface 275.

The reader will note that the pad 262 is release ably attached to the frame pad surface 275 and the dowel surface 231. The releasable attachment mechanism may be hook and loop portions or releasable adhesive, or snaps, and or any other methods known in the art. There may be numerous dowel surfaces 231. The base pad surface 273 acts as a backing surface but does not adhere to the pad 262 as compared to the frame pad surface 275 and the dowel surface 231.

I claim:

1. A cleaning device comprises:

a) a pole assembly adapted to be detachably connected to a pole end;

b) a head assembly adapted to be detachably connected to a pad;

c) a resilient joint connected at a pole portion to the pole assembly and at a head end to the head assembly;

d) wherein the resilient joint includes a flexible neck disposed between the pole portion and the head end;

e) the cleaning device is moveable between a normally retracted position and an extended position, wherein in the retracted position, the pole assembly pivots about the flexible neck relative the head assembly;

f) wherein the resilient joint further includes a pin channel which extends through the flexible neck, and the pole assembly includes an actuator attached to a plunger pin, whereby selectively urging the actuator longitudinally downward urges the plunger pin downward to extend through the flexible neck into the extended position, such that the plunger pin prevents pivoting of the flexible neck and thereby locks the position of the pole assembly relative to the head assembly in the extended position;

g) wherein the pole assembly further includes a rigid pole receiver configured to detachably connect to the pole end, the pole receiver is connected to the resilient joint at the pole portion;

h) wherein the actuator includes a plunger rigidly connected to the plunger pin, the plunger is slide-ably received along the pole receiver; the plunger is operably biased in a normally retracted position with a plunger spring which is mounted around the plunger pin.

i) wherein the pole receiver includes a semi cylindrical portion with an internal diameter dimensioned to fit around the pole end and the plunger includes a plunger semi cylindrical portion configured to slide-ably fit around an external diameter of the pole receiver, wherein the plunger slides longitudinally along the pole receiver.

2. The cleaning device claimed in claim 1 wherein in the normally retracted position the plunger spring biases the actuator such that the plunger pin is operably retracted out of the pin channel thereby allowing the pole assembly to pivot about the flexible neck relative the head assembly.

3. The cleaning device claimed in claim 1 wherein the actuator further includes a handle connected to a distal end of an arm, wherein the arm is connected to the plunger which in turn is connected to the plunger pin, such that upon urging the handle downwardly the cleaning device moves from -a- the retracted position to an the extended position.

4. The cleaning device claimed in claim 1 wherein the head assembly includes a base slide-ably received within a frame which is rigidly attached to the head end of the resilient joint, wherein in the base is moveable between the retracted position and the extended position wherein the retracted position the frame is adapted to connect to the pad in an attached position and in the extended position the frame is adapted to release the pad in a detached position.

5. The cleaning device claimed in claim 4 wherein the base includes a pin contact surface for receiving a push end of the plunger pin thereon such that urging the plunger pin downwardly urges the base slide-ably away from the frame thereby releasing the pad.

6. The cleaning device claimed in claim 5 wherein the base includes downwardly disposed base guide walls slide-ably received onto downwardly disposed frame guide posts attached to the frame and connected by a planar frame pad portion, such that the posts and the walls guide the base longitudinally downwardly when the base is urged between the retracted position and the extended position.

7. The cleaning device claimed in claim 6 wherein the head assembly further includes retraction springs mounted around the posts for urging the base into the retracted position.

8. The cleaning device claimed in claim 5 wherein the base includes a base pad surface which provides a rigid abutting surface for the pad which does not adhere to the pad.

9. The cleaning device claimed in claim 8 wherein the base includes a planar base pad surface and the frame includes a planar frame pad surface which is detachably attached to the pad, such that in the retracted position the base pad surface and the frame pad surface align along a common plane, and in the extended position these two surfaces are aligned along longitudinally spaced apart planes, thereby detaching the pad from the frame pad surface in the detached position.

10. The cleaning device claimed in claim 9 wherein the frame further includes a sub-frame which includes locating dowels each having a dowel surface detachably attached to the pad, such that in the retracted position the base pad surface, the frame pad surface and the dowel surface align along the common plane, and in the extended position the base pad surface lies along a longitudinally spaced apart plane from the frame base pad surface and the dowel surface such that the pad is detached from the frame pad surface and the dowel surface.

* * * * *